United States Patent [19]

Tsuge

[11] Patent Number: 4,924,047

[45] Date of Patent: May 8, 1990

[54] SEESAW SWITCH

[75] Inventor: Kazuya Tsuge, Shimane, Japan

[73] Assignee: Omron Tateisi Electronics Co., Kyoto, Japan

[21] Appl. No.: 315,228

[22] Filed: Feb. 24, 1989

Related U.S. Application Data

[63] Continuation of Ser. No. 97,005, Sep. 14, 1987, abandoned.

[30] Foreign Application Priority Data

Sep. 16, 1986 [JP] Japan ..... 61-140611
Sep. 16, 1986 [JP] Japan ..... 61-140612
Sep. 16, 1986 [JP] Japan ..... 61-140613

[51] Int. Cl.[5] ..... H01H 23/08

[52] U.S. Cl. ..... 200/553; 200/305; 200/339

[58] Field of Search ..... 200/438, 459, 553, 556, 200/557, 339, 305

[56] References Cited

U.S. PATENT DOCUMENTS 3,075,062 1/1963 Iaccarino ..... 200/339
3,225,156 12/1965 Sahrbacker ..... 200/557 X
3,588,402 6/1971 Heath ..... 200/68.1
3,639,714 2/1972 Fujimoto et al. ..... 200/153 J
3,735,077 5/1973 Ohashi ..... 200/68.2
3,879,592 4/1975 Comerford et al. ..... 200/339
4,447,689 5/1984 Schiller ..... 200/438 X
4,814,554 3/1989 Magiera ..... 200/438 X

FOREIGN PATENT DOCUMENTS 1192289 5/1965 Fed. Rep. of Germany ..... 200/68.2
1229615 12/1966 Fed. Rep. of Germany ..... 200/68.1

*Primary Examiner*—Renee S. Luebke
*Attorney, Agent, or Firm*—Wegner & Bretschneider

[57] ABSTRACT

A switch is disclosed having a case, a button with an operation portion and housed in the case, a fixed terminal fixed to the case, and a generally U-shaped movable piece having one end rotatably held by a holding member while the other end being provided with a movable contact for making and breaking contact with a fixed contact of the fixed terminal. The generally U-shaped movable piece has a middle portion which is in contact with the operation portion of the button between the movable contact and a bent portion of the movable piece.

8 Claims, 4 Drawing Sheets

SEESAW SWITCH

This application is a continuation of U.S. application Ser. No. 097,005, filed Sept. 14, 1987 abandoned.

BACKGROUND OF THE INVENTION

This invention relates to a switch and, more particularly, to a seesaw switch.

Generally, a seesaw switch has a conductive piece which is moved by an operation button. The end of the conductive piece has a movable contact suitable for contacting a fixed contact when the conductive piece is moved by the operation button. A spring is provided to press the operation button against the conductive piece so that the operation button can be operated in a snap action. Thus, the spring is incorporated when assembling the switch which gives a bias to the operation button.

However, due to the small sizes of the above-mentioned parts, it is very troublesome and time consuming to incorporate the spring into the switch assembly. Moreover, the operation button is set free during assembling so that it is likely to pop out from the end of the spring.

In order to solve the above problems, a piece of elastic metal plate is used as a U-shaped movable piece wherein one end of the movable piece is pressed by an operation portion of a button. Thus, the use of an additional spring as shown in FIG. 3 is eliminated.

In FIG. 3 (see also British Patent No. 1 486 163), a case 1 has a bottom wall 1A wherein a common terminal 2 and fixed terminals 3 and 4 are provided. The common terminal 2 is placed between fixed terminals 3 and 4. The upper opening of case 1 accommodates an operation button 6 which is rotatably supported by a shaft 5 mounted between the side walls of case 1. The button 6 is made of epoxy resin and its lower portion forms a wedge 7 which operates a movable piece 8. The movable piece 8 is bent at its middle portion and portion 8A is biased by wedge 7 while another portion 8B is held by common terminal 2. A tip 2A of the common terminal 2 is pointed to meet dent 8C defined in piece 8B, thereby forming a fulcrum A.

When the operation button 6 is pressed, the wedge 7 passes over the fulcrum A, which in turn moves movable piece 8 to perform a switch operation as shown in broken lines. The broken lines show that movable piece 8 contacts fixed contact 3 without contacting fixed contact 4. The solid lines illustrating the movable piece 8 shows the movable piece 8 being in contact with fixed contact 4 without contacting fixed contact 3.

The U-shaped movable piece 8 is intended to provide a snap action during the operation of the operation button 6. Generally, a pressing force between contacts should be large enough to make the switch operable and secure, particularly for use in large capacity switches. However, the switch shown and described in FIG. 3 cannot apply sufficient pressing force to movable piece 8 by rotating operation button 6. In other words, the switch structure shown in FIG. 3 is not designed to provide a "wiping effect" as the movable piece 8 slides over and contacts fixed contact 3, thus cannot increase its contacting force.

Therefore, the conventional switch structure shown in FIG. 3 is not applicable to large capacity current switches. Moreover, it cannot secure high reliability in switching operations.

SUMMARY OF THE INVENTION

In order to solve the above problems, this invention provides a switch which can provide a higher contacting force between contacts and, as well as a wiping effect between contacting members.

A switch according to this invention, comprises a case, a button having an operation portion, a fixed terminal fixed to the case, and a generally U-shaped movable piece having one end being rotatably held by a holding member while the other end being provided with a movable contact for making and breaking contact with a fixed contact of the fixed terminal. The generally U-shaped movable piece is in contact with the operation portion at its middle portion between the movable contact and a bent portion thereof.

The foregoing and other objects, features and advantages of this invention will be apparent from the following, more particular, description of the preferred embodiments of this invention, as illustrated in the accompanying drawings.

DETAILED DESCRIPTION OF THE PREFERRED EMBODIMENTS

Figure 1:
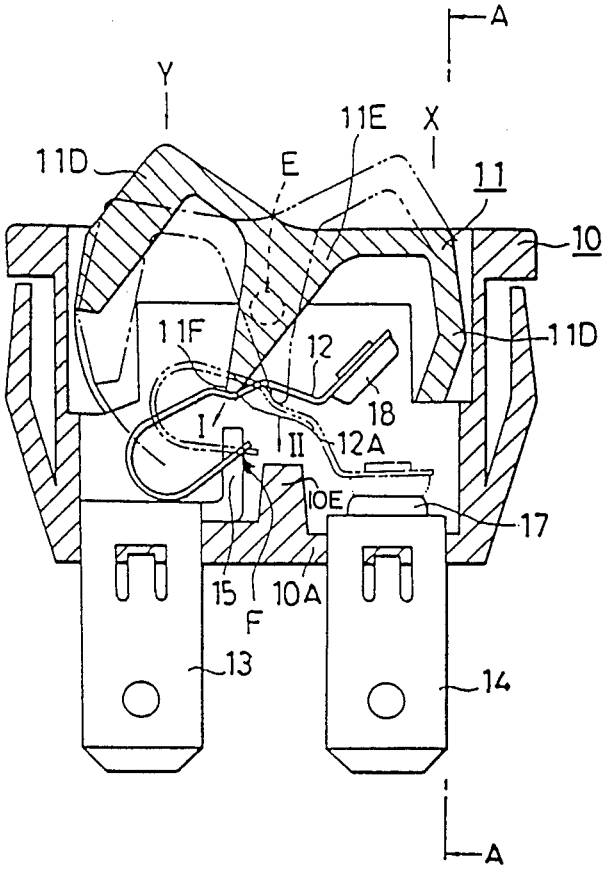
FIG. 1 shows a partial cross-sectional view of one embodiment of a switch in accordance with the present invention.
Figure 2:
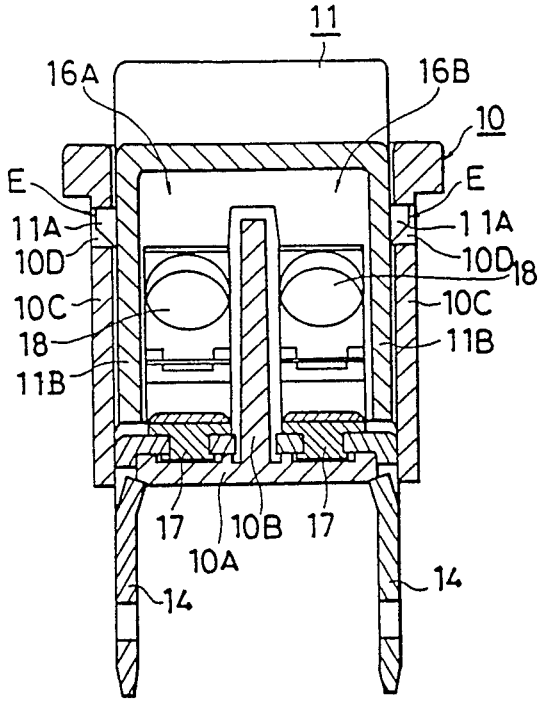
FIG. 2 shows a cross sectional view of the switch taken in the direction of arrows A—A shown in FIG. 1.
Figure 3:
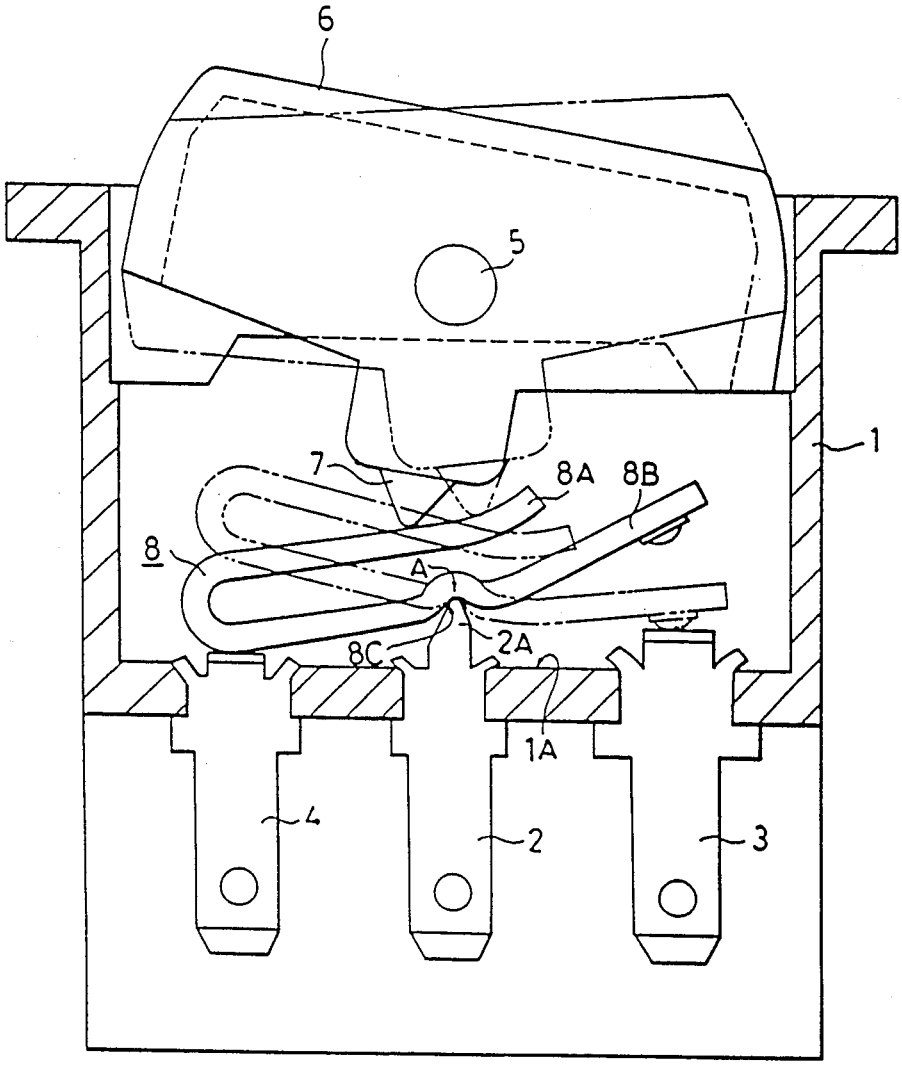
FIG. 3 PRIOR ART
FIG. 3 shows a switch of a related art.

In FIGS. 1 and 2, a preferred embodiment of a switch of this invention comprises a case 10, an operation button 11, a movable piece 12, a first fixed terminal 13 and a second fixed terminal 14. The case 10 is made of epoxy resin having the terminals 13 and 14 inserted and molded therein. The case 10 is separated into two chambers 16A and 16B by a partition wall 10B rising from a bottom wall 10A. The chambers 16A and 16B are similar in terms of configurations. A pair of side walls 10C of case 10 (shown in FIG. 2) opposing each other have respective holes 10D into which a pair of pins 11A formed on the external surfaces of side walls 11B of operation button 11 are engaged.

The first fixed terminal 13 has one end folded downwardly and extended outside the case 10 and another end folded upwardly to form a holding member 15. The second fixed terminal 14 has one end folded downwardly and extended outside the case 10 while another end has a fixed contact 17 mounted thereon with its surface formed in an upward direction. A projection 10E projects upwardly from the bottom wall 10A of case 10 between the fixed terminals 13 and 14.

The operation button 11 made of epoxy resin is preferably molded in one piece and has pins 11A engaged in holes 10D to form a rotation fulcrum E. The internal surface of operation button 11 is formed in a generally cap-like shape having a pair of side walls 11B and a pair of side walls 11D, thus defining an downward opening.

A pair of operation portions 11E project from the center of internal surface of operation button 11 in a manner such that a partition wall 10B is provided between chambers 16A and 16B. A pair of tips 11F of operation portions 11E are generally rounded.

The movable piece 12 is formed in a U-like configuration by the folding of a middle portion of a metal plate whereby one end of the movable piece 12 is rotatably held by a holding member 15 defined at an end of fixed terminal 13. A rotation fulcrum F is thus formed. The rotation fulcrum F is located in a position laterally displaced from the rotation fulcrum E of operation button 11. In other words, the fulcrum F is slightly closer to fixed terminal 13. The other end of movable piece 12 extends over rotation fulcrum F towards a fixed terminal 14. The extended end of the movable piece 12 has a movable contact 18 for contacting to a fixed contact 17 mounted on fixed terminal 14.

Between the middle bent portion and the extended end of the movable piece 12, there is a positioning step 12A which is formed in a generally V-like shape. The movable piece 12 is disposed between a tip 11F of operation portion 11E and the first fixed terminal 13 in a spring charged manner.

In operation, when operation button 11 is pressed, the tip 11F of operation portion 11E moves over fulcrum F while the movable piece 12 is being pressed at step 12A so that the movable piece 12 rotates around fulcrum F.

Thus, as shown in a broken lines and solid lines, movable contact 18 makes and breaks contact with fixed contact 17. Specifically, the solid lines show that operation button 11 is rotated clockwise around fulcrum E by a pressing force X whereby the tip 11F is located on the left side of and over fulcrum F. The operation portion 11E applies a force on movable piece 12 in a direction I so that movable piece 12 rotates counterclockwise around fulcrum F to break a contact between movable contact 18 and fixed contact 17.

On the other hand, when operation button 11 is pressed in a direction Y, the button 11 rotates counterclockwise around fulcrum E as shown in broken lines. In this condition, the tip 11F is on the right side and over fulcrum F and almost in vertical line with fulcrum E. When a force is applied from operation portion 11E to movable piece 12 in a direction of II, the movable piece 12 rotates clockwise around fulcrum F to make a contact between movable contact 18 and fixed contact 17.

When a contact between movable contact 18 and fixed contact 17 takes place, a strong counterclockwise pressing force is applied on step 12A by operation portion 11E. As a result, the movable contact 18 applies a sufficient wiping force towards the right direction over fixed contact 17.

Accordingly, in this preferred embodiment, the rotating pressing force is applied directly over a portion of movable piece 12 having movable contact 18 wherebY the movable contact 18 gets a wiping force against fixed contact 17, thus securing the contact operation between movable contact 18 and fixed contact 17 and enabling an application to large-capacity type switches.

The holding member 15 may be formed as a part of case 10 instead of fixed contact 13 and the movable contact may be disposed to electrically connect two fixed contacts.

Figure 4:
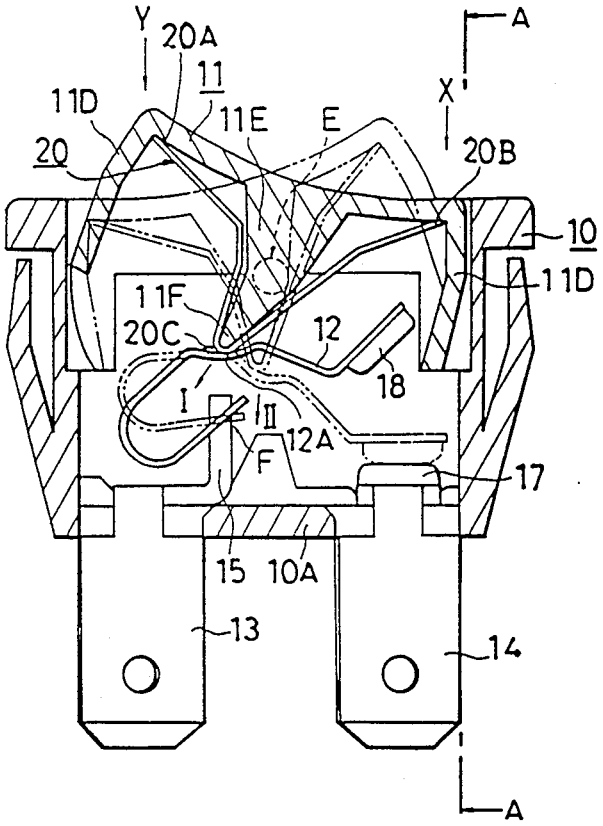
FIG. 4 shows a partial cross-sectional view of the switch having a metallic cover on the operation portion of the switch button.

In another embodiment of this invention, shown in FIG. 4, a metallic plate spring 20 covers operation portion 11E. The plate spring 20 is generally V-like in configuration and both of its ends 20 A and 20B are mounted in internal corners of operation button 11 in a spring charged manner. The central end portion 20C is formed so as to cover the tip 11F. In this embodiment, the plate spring 20 improves slidability between operation button 11 and movable piece 12, thereby reducing wear due to friction when in operation.

While the invention has been particularly shown and described in reference to preferred embodiments thereof, it will be understood by those skilled in the art that changes in form and details may be made without departing from the spirit and scope of the invention.

What is claimed is:

1. A switch comprising:

a case having a bottom wall and upwardly extending side walls;

a button having an operation portion and housed within the case;

a first and a second fixed terminal fixed to the case, said first fixed terminal having an upwardly extending holding portion, said second fixed terminal having a fixed contact;

a generally U-shaped movable piece having one end rotatably held by the holding portion of the first fixed terminal while another end is provided with a movable contact for making and breaking contact with the fixed contact of the second fixed terminal, wherein the generally U-shaped movable piece has a middle portion which is in contact with the operation portion of the button between the movable contact and a bent portion of the movable piece; and isolating means for isolating said first fixed contact and said second fixed contact, wherein said isolation means comprises a projection extending upwardly from the bottom wall of the case between the first and second fixed terminals, and wherein said projection is entirely disposed between the first and second fixed contacts.

2. The switch as in claim 1, wherein the case has a partition wall protruding from the bottom wall of the case.

3. The switch as in claim 1, wherein the button has at least two outwardly extending pins for engaging into apertures of the side walls of the case.

4. The switch as in claim 1, wherein a rotation fulcrum of the movable piece is formed at the holding portion.

5. The switch as in claim 1, wherein the operation portion is covered with a metal plate.

6. The switch as in claim 1, wherein the operation portion is covered with a metal plate having ends mounted in internal corners of the button in a spring charged manner.

7. The switch as in claim 1, wherein a rotation fulcrum of the movable piece is disposed at an opposite side relative to the movable contact and laterally displaced from a rotation fulcrum of the button.

8. The switch as in claim 7, wherein the movable contact is located above the rotation fulcrum of the movable piece when the movable piece is in a fully disconnected position, and wherein the movable contact is located below the rotation fulcrum of the movable piece when the movable piece is in a fully connected position.

* * * * *